US008556476B2

(12) United States Patent
Ding

(10) Patent No.: US 8,556,476 B2
(45) Date of Patent: Oct. 15, 2013

(54) ELECTRONIC CANDLE

(75) Inventor: Yingqi Ding, Nantong (CN)

(73) Assignee: Nantong Ya Tai Candle Arts & Crafts Co., Ltd, Nantong (CN)

( * ) Notice: Subject to any disclaimer, the term of this patent is extended or adjusted under 35 U.S.C. 154(b) by 0 days.

(21) Appl. No.: 13/209,906

(22) Filed: Aug. 15, 2011

(65) Prior Publication Data

US 2012/0307516 A1 Dec. 6, 2012

(30) Foreign Application Priority Data

Jun. 1, 2011 (CN) ..... 2011 1 0146070

(51) Int. Cl.
*F21V 21/00* (2006.01)

(52) U.S. Cl.
USPC ..... 362/392; 362/84; 362/161

(58) Field of Classification Search
USPC ..... 362/84, 392, 161
See application file for complete search history.

(56) References Cited

U.S. PATENT DOCUMENTS 7,360,935 B2 * 4/2008 Jensen et al. ..... 362/555
2008/0094825 A1 * 4/2008 Silver ..... 362/161

FOREIGN PATENT DOCUMENTS

CN 201025337 2/2008

* cited by examiner

*Primary Examiner* — Sean Gramling
(74) *Attorney, Agent, or Firm* — Westerman, Hattori, Daniels & Adrian, LLP

(57) ABSTRACT

The present invention discloses an electronic candle, consisting of a body, which is provided with a luminescent film on the wall and internally with a cavity. The said cavity is installed internally with an electronic control device controlling the said luminescent film. With reasonable structure and luminescent film positioned on the wall of the body, the candle wall flashes by controlling the electronic control device of the luminescent film, thus diversifying the colors and patterns on the wall.

13 Claims, 2 Drawing Sheets

ELECTRONIC CANDLE

FILED OF THE INVENTION

The present invention relates to a candle, particularly to an illuminant electronic candle.

BACKGROUND OF THE INVENTION

The ignition-typed candle in the prior art is cheap, but having hidden safety troubles. There are pluralities of commercial electronic candles, wherein most adopt plastic bodies, and a few adopt wax bodies with monotonic patterns and colors, thus difficult in diversifying the patterns and colors on one body. The illuminator of conventional electronic candle is mounted on the wick without lights originated from the body, thus failed to better present the engraved style and shape with lights, especially, even failed to exhibit the aesthetic look of body with sparks in the darkness.

SUMMARY OF THE INVENTION

Object of the present invention: the present invention is to settle the technical shortcoming in the prior art, to provide a safe and true aesthetic electronic candle.

The technical schemes in the invention: an electronic candle, consisting of a body which is internally provided with a luminescent film on the wall. The said body is internally provided with a cavity which an electronic control device of the said luminescent film is internally mounted.

As a further improvement of the invention, the said luminescent film is embedded in the wall of said body, enabling the luminescent film wrapped and cold-set against sliding.

As a further improvement of the invention, the said luminescent film is fabricated into diversified patterns, hues and shapes, thus adding the tones of the candle wall.

As a further improvement of the invention, the said luminescent film is also installed with an illuminator and electronic controllers of the illuminator internally, achieving radiance from the body through the illuminator inside the cavity.

As a further improvement of the invention, the said illuminator is connected with a light conductor which extends to the surface of the body through the cavity top to form a segment of light conducting wick. The lights from the illuminator cast onto the surface through the light conductor to form a brilliant wick.

As a further improvement of the invention, the said light conductor is an optical fiber with a good light conducting effect.

As a further improvement of the invention, the said illuminator and light conductor are covered with a fixing tube at the contact portion, fastening the bottom of the light conductor and the top of the illuminator in excluding the displacement between the said illuminator and light conductor against that the lights originated from the illuminator fail to radiate through the light conductor, or the said illuminator is provided with a transparent lampshade which is connected to the said light conductor for converging and radiating the lights from the light conductor that is connected to the lampshade top.

As a further improvement of the invention, the said light conducting wick is provided with a light-blocking body, which is wrapped with black or white plastic sheet or dyed into a black or white wick, thus making allowing a truer effect of simulative electronic candle just as the wick bottom does not illuminate or burnt black.

As a further improvement of the invention, the said body is provided an electronic control device and a driver of an electronic controller at the bottom, thus not affecting the aesthetic look of the body with a better true effect.

As a further improvement of the invention, the said driver is connected to an integrated circuit arrangement controlling the patterns of the luminescent film, thus intentionally achieving colorful effects in different times for the luminescent film.

The body of the electronic candle in the invention may be either a wax or plastic body, or wax liquid or wax in a glass container or transparent container or candle-shaped illuminator. The said illuminator is embedded with the luminescent film, having a light conducting technique of the light conductor in the present invention.

Benefit effect: the present invention is reasonable in structure, achieving diversified colorful light effects and patterns in different times by controlling the electronic control device of the luminescent film through the luminescent film embedded in the wall of the body. The lights out of the illuminator in the cavity of the body casts onto the candle surface along the light conductor to form a wick with flash effect, thus safety in use and with good effect; the lights out of illuminator in the cavity of the body radiate out through the semi-transparent candle aesthetically.

EMBODIMENTS

The present invention is hereinafter further instructed with accompanying drawings and embodiments. The protection scope of the invention includes, nevertheless not limited to the following embodiments, complete with the simple alternations of technical features in the similar or equal technical effects.

Embodiment 1

Figure 1:
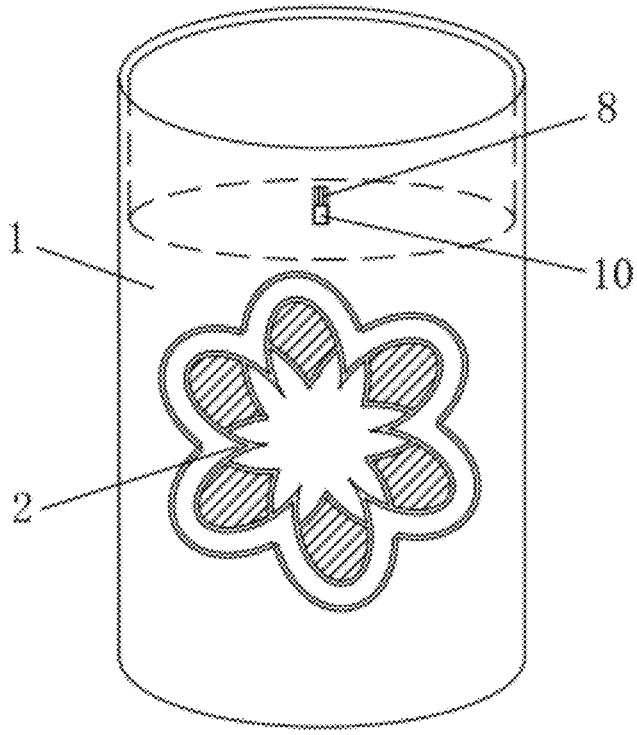
FIG. 1 is a structural schematic view of the electronic candle appearance in the invention.
Figure 2:
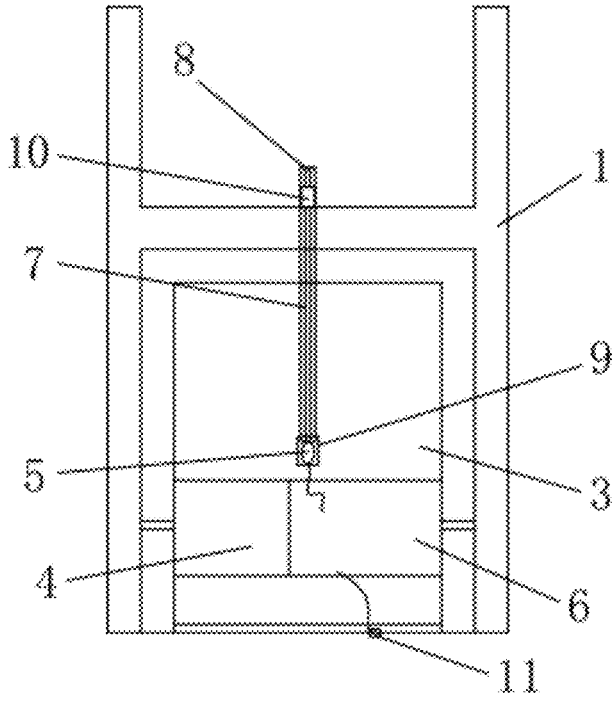
FIG. 2 is a sectional view of an embodiment in the invention.
Figure 4:
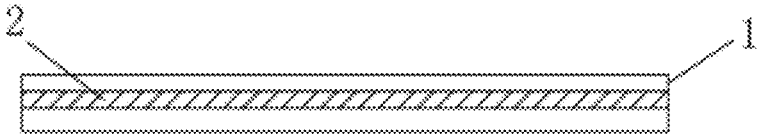
FIG. 4 is a sectional structural schematic view of the electronic candle wall with the luminescent film embedded.
Figure 5:
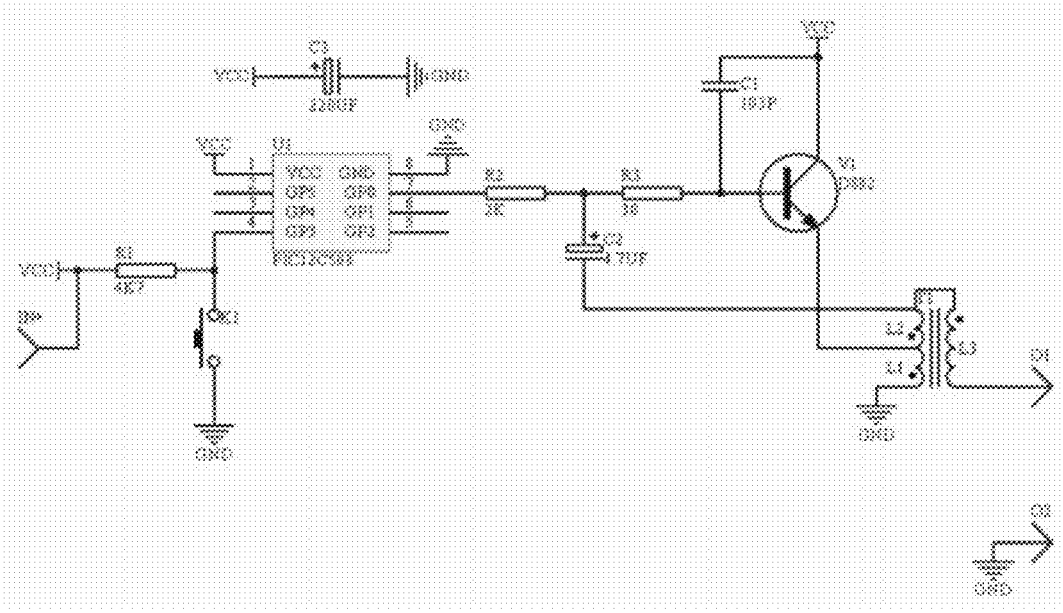
FIG. 5 is a circuit diagram of the electronic control device in the invention.

An electronic candle, consisting of a plastic body 1 as illustrated in FIGS. 1, 2, 4 and 5. The said body 1 is provided with a luminescent film 2 with diversified patterns and colors on the wall and internally with a cavity 3, the said cavity 3 is installed internally with an electronic control device 4 controlling the said luminescent film 2, the said cavity 3 is internally mounted with an illuminator 5 and an electronic controller 6 of the said illuminator 5, the said illuminator 5 connected to a light conductor 7, the said light conductor 7 extends to the surface of the body 1 through the said cavity 3 top to form the segment of a light conducting wick 8, the said illuminator 5 and light conductor 7 are covered with a fixing tube 9 at the contact portion, the said light conducting wick 8 is provided with a black light-blacking wick 10 at the bottom section, the said body 1 is provided with the electronic control device 4 and the driver 11 of the electronic controller 6, the said driver 11 is connected to an integrated circuit device controlling the patterns of the luminescent film 2.

Embodiment 2

An electronic candle, consisting of a wax body 1 as illustrated in FIGS. 1, 2, 4 and 5, the said body 1 is provided with a luminescent film 2 with diversified patterns and colors on the wall and internally with a cavity 3, the said cavity 3 is installed internally with an electronic control device 4 controlling the said luminescent film 2, the said cavity 3 is internally mounted with an illuminator 5 and an electronic controller 6 of the said illuminator 5, the said illuminator 5 is connected to an optical fiber conductor 7, which extends to the surface of the body 1 through the said cavity 3 top to form the segment of an optical fiber wick 8, the said illuminator 5 is provided with a transparent lampshade 12, which is connected to the said optical fiber conductor 7 on the top, the said optical fiber wick 8 is wrapped with a black plastic sheet into a black light-blocking wick 10 at the lower segment, the said body 1 is provided with the electronic control device 4 and the driver 11 of the electronic controller 6, the said driver 11 is connected to an integrated circuit device controlling the patterns of the luminescent film 2.

Embodiment 3

Figure 3:
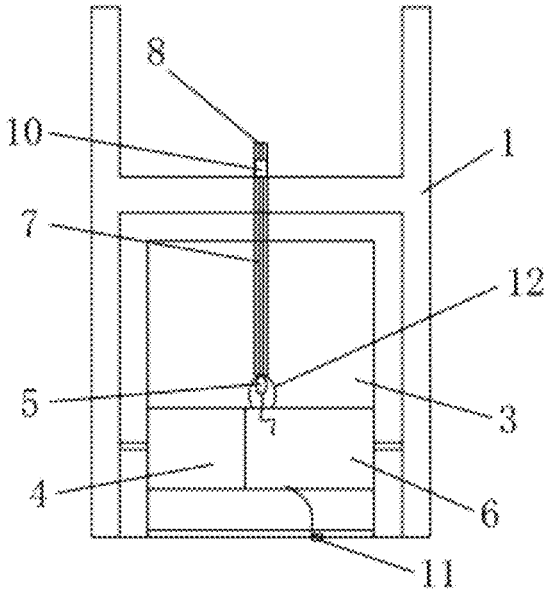
FIG. 3 is a sectional view of another embodiment in the invention.

An electronic candle, consisting of a wax body 1 as illustrated in FIGS. 1, 3, 4 and 5, the said body 1 is provided with a luminescent film 2 with diversified patterns and colors on the wall and internally with a cavity 3, the said cavity 3 is installed internally with an electronic control device 4 controlling the said luminescent film 2, the said cavity (3) is internally mounted with an illuminator (5) and an electronic controller (6) of the said illuminator (5), the said illuminator 5 is connected to an optical fiber conductor 7, which extends to the surface of the body 1 through the said cavity 3 top to form the segment of an optical fiber wick 8, the said illuminator 5 is provided with a transparent lampshade 12, which is connected to the said optical fiber conductor 7 on the top, the said optical fiber wick 8 is wrapped with a black plastic sheet into a black light-blocking wick 10 at the lower segment, the said body 1 is provided with the electronic control device 4 and the driver 11 of the electronic controller 6 at the bottom, the said driver 11 is connected to an integrated circuit device controlling the patterns of the luminescent film 2.

The invention claimed is:

1. An electronic candle, comprising:

a single body (1), wherein the said body (1) is provided with a luminescent film (2) and internally with a cavity (3), wherein the luminescent film is embedded directly within a semi-transparent outer wall of the single body such that the luminescent film is sandwiched between an outer surface of said outer wall of the single body and an inner surface of said outer wall of said single body, wherein the cavity (3) is internally mounted with an electronic controller device (4) of the luminescent film (2), an illuminator (5) and an electronic controller (6) of the illuminator (5), and wherein said illuminator is connected with a light conductor (7), wherein said light conductor extends through a top of said body (1) and down through said cavity to said illuminator (5), said illuminator (5) being displaced from said top of said body (1) to a position within said cavity adjacent said luminescent film (2), wherein a width of said outer wall of said body at said position is substantially smaller than a width of said cavity at said position, and wherein said illuminator and said outer wall are configured to radiate light from said illuminator laterally outward through said semi-transparent outer wall proximate said luminescent film.

2. The electronic candle according to claim 1, wherein the said luminescent film (2) is diversified in colors and patterns.

3. The electronic candle according to claim 1, wherein said light conductor (7) extends to the surface of the said body (1) through the said illuminator (7) to form a section of light conducting wick (8).

4. The electronic candle according to claim 3, wherein the said light conductor (7) is an optical fiber.

5. The electronic candle according to claim 3, wherein the said illuminator (5) and said light conductor (7) are covered with a fixing tube (9) at the contact portion, or the said illuminator (5) is provided with a transparent lampshade (12) which is connected to the said light conductor (7) on the top.

6. The electronic candle according to claim 3, wherein the said light conducting wick (8) is provided with a lightblocking body (10) at the lower segment.

7. The electronic candle according to claim 6, wherein the said light-blocking body (10) is a black or white wick dyed or wrapped with a black or white plastic sheet.

8. The electronic candle according to claim 1, wherein the said body (1) is provided with an electronic control device (4) and a driver (11) of an electronic controller (6).

9. The electronic candle according to claim 1, wherein the said driver (11) is coupled with an integrated circuit arrangement controlling the patterns of the luminescent film (2).

10. The electronic candle according to claim 5, wherein the said illuminator (5) and said light conductor (7) are covered with a fixing tube (9) at a contact portion.

11. The electronic candle according to claim 5, wherein the said illuminator (5) is provided with a transparent lampshade (12) which is connected to said light conductor (7) on the top.

12. The electronic candle according to claim 1, wherein said light conductor extends through a top of said body (1) and down through said cavity to said illuminator (5), wherein said illuminator (5) is displaced from said top of said body (1) to a position proximate a mid-height of said body (1).

13. The electronic candle according to claim 1, wherein said single body is a unitary body made of wax or plastic.

* * * * *